US005797059A

United States Patent [19]

Yoshizawa et al.

[11] Patent Number: 5,797,059

[45] Date of Patent: Aug. 18, 1998

[54] PHOTOGRAPHIC PROCESSING APPARATUS

[75] Inventors: Seiichi Yoshizawa; Yoko Takegawa; Akira Sugiyama; Motoi Suzuki; Ryoei Nozawa, all of Kanagawa, Japan

[73] Assignee: Fuji Photo Film Co., Ltd., Kanagawa, Japan

[21] Appl. No.: 798,264

[22] Filed: Feb. 11, 1997

[30] Foreign Application Priority Data

Feb. 15, 1996 [JP] Japan ..... 8-027923

[51] Int. Cl.[6] ..... G03D 3/02

[52] U.S. Cl. ..... 396/626

[58] Field of Search ..... 396/578, 626, 396/630, 627, 636

[56] References Cited

FOREIGN PATENT DOCUMENTS 736810 10/1996 European Pat. Off. .

*Primary Examiner*—D. Rutledge

*Attorney, Agent, or Firm*—Sughrue, Mion, Zinn, Macpeak & Seas, PLLC

[57] ABSTRACT

A photographic processing apparatus includes a replenisher supplying mechanism for forcibly supplying a remaining portion of a replenisher if the replenisher remains in a replenisher container or pack when the processing of a predetermined quantity of photosensitive material has been finished and a controlling mechanism which displays an abnormality message on a display if the forcibly supplied quantity of replenisher has exceeded a predetermined quantity. If it is detected that the replenisher pack has become empty before the processing of the predetermined quantity of photosensitive material is finished, the abnormality message is displayed. If all the quantities of replenishers forcibly supplied from a plurality of replenisher packs are not more than predetermined quantities, only a message for replacing the replenisher packs is displayed. If the quantity of replenisher forcibly supplied from one of the replenisher packs is not more than the predetermined quantity, and if the replenisher pack has become empty before the processing of the predetermined quantity of photosensitive material is finished, both the abnormality message and the replace message are displayed. It is thus possible to ascertain the timing of replacing a replenisher pack not provided with a level sensor and to ascertain the state of a replenisher pump.

16 Claims, 5 Drawing Sheets

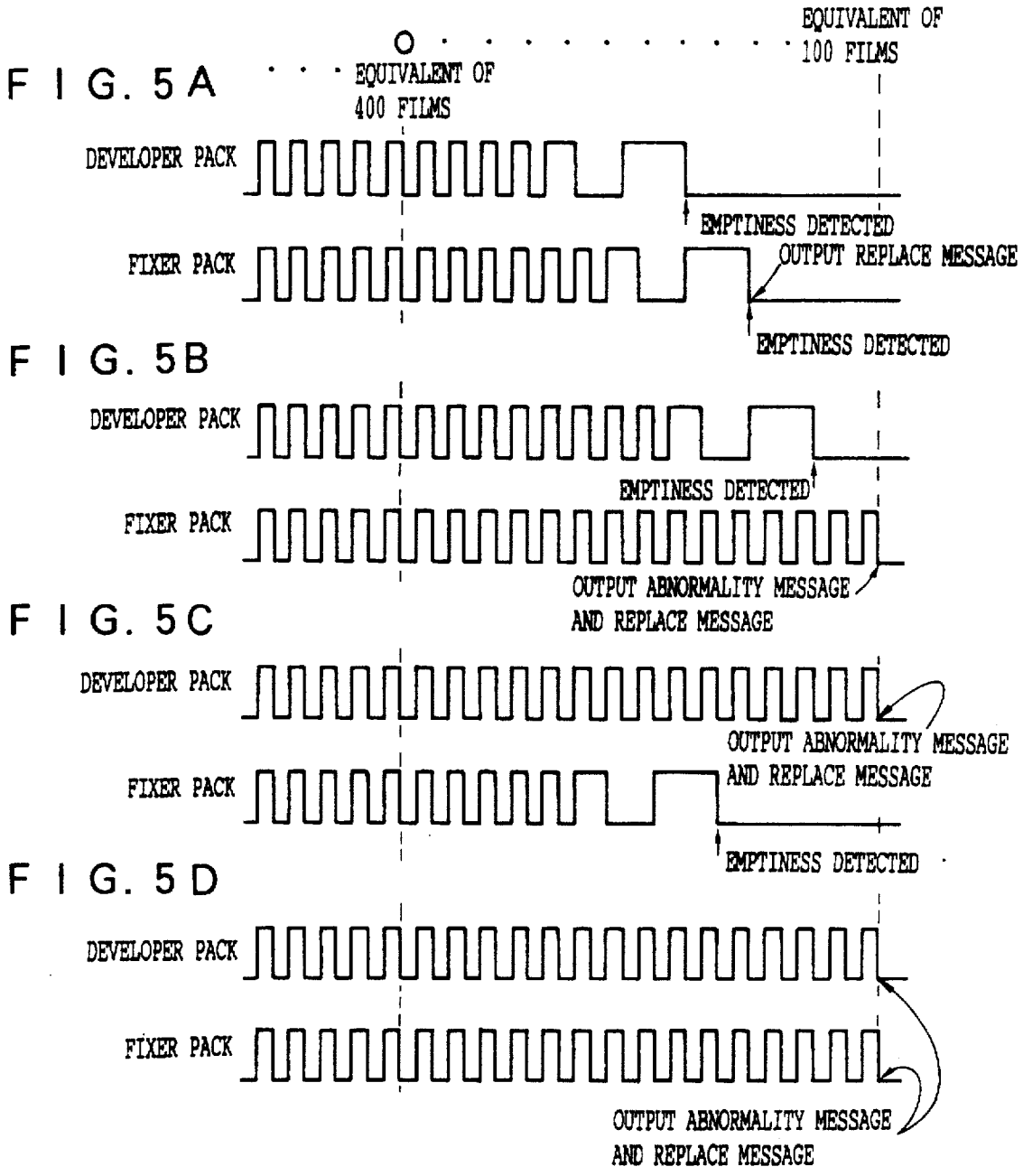
FIG. 5A
O
EQUIVALENT OF 400 FILMS
EQUIVALENT OF 100 FILMS
DEVELOPER PACK
EMPTINESS DETECTED
FIXER PACK
OUTPUT REPLACE MESSAGE
EMPTINESS DETECTED
FIG. 5B
DEVELOPER PACK
EMPTINESS DETECTED
FIXER PACK
OUTPUT ABNORMALITY MESSAGE AND REPLACE MESSAGE
FIG. 5C
DEVELOPER PACK
OUTPUT ABNORMALITY MESSAGE AND REPLACE MESSAGE
FIXER PACK
EMPTINESS DETECTED
FIG. 5D
DEVELOPER PACK
FIXER PACK
OUTPUT ABNORMALITY MESSAGE AND REPLACE MESSAGE

PHOTOGRAPHIC PROCESSING APPARATUS

BACKGROUND OF THE INVENTION

1. Field of the Invention

The present invention relates to a photographic processing apparatus in which a photosensitive material is immersed in a processing solution in a processing tank, and more particularly to a photographic processing apparatus having a replenisher supplying mechanism for replenishing a replenisher for the processing solution to the processing tank.

2. Description of the Related Art

Conventionally, in a photographic processing apparatus, an attempt is made to maintain the processing capabilities of a processing solution by replenishing a replenisher in accordance with the amount of processed photosensitive material or with respect to the processing solution which deteriorates with the lapse of time. A generally adopted structure for replenishment is such that a replenisher is accommodated in a replenisher tank, and a necessary quantity of the replenisher is replenished to a processing tank by operating a pump, as required.

In the case of such a structure, a measure is generally provided to constantly store a predetermined quantity or more of replenisher in the replenisher tank so as to allow the replenisher to be replenished as necessary. For this reason, a level sensor is provided in the replenisher tank so as to detect the liquid level, thereby ascertaining a timing of replenishing the replenisher to the replenisher tank.

However, in the light of the problem of deterioration thereof during storage, a replenisher is generally prepared immediately before being supplied, or it is sealed in a hard nonpliable replenisher container, and such a replenisher is used after being temporarily supplied to the replenisher tank. Hence, there has been a drawback in that the replenishment operation takes time and is troublesome, and there has been a drawback in the recovery of the containers.

On the other hand, an apparatus has been proposed in which, instead of using a replenisher tank, the replenisher is directly supplied to the processing tank from a replenisher pack in which the replenisher is sealed in a state of being isolated from the air. However, since such a bag-shaped replenisher pack cannot be provided with a level sensor for detecting the liquid level in the light of its structure, there has been a problem in that it is impossible to ascertain the remaining quantity of replenisher, making it impossible to ascertain the timing for replacing the replenisher pack.

Further, in a case where a plurality of kinds of replenishers (for example, replenishers for developer and fixer) are used, since each replenisher is replenished by the operation of an independent pump, there have been cases where the timings of replacing the replenisher packs do not concur.

SUMMARY OF THE INVENTION

In view of the above-described circumstances, it is an object of the present invention to provide a photographic processing apparatus which makes it possible to ascertain the timing of replacing a replenisher pack incapable of detecting the liquid level, which makes it possible to replace a plurality of replenisher packs at the same time, and which makes it possible to detect an abnormality of a replenisher pump (a replenisher supplying mechanism).

To this end, in accordance with a first aspect of the present invention, there is provided a photographic processing apparatus in which a processing replenisher is replenished from a replenisher container to a processing tank in a quantity proportional to a quantity of a photosensitive material processed by being immersed in a processing solution, the photographic processing apparatus comprising: an emptiness detecting mechanism for detecting an empty state of the replenisher container; a replenisher supplying mechanism for replenishing the replenisher from the replenisher container to the processing tank; a determining mechanism for determining a function of the replenisher supplying mechanism on the basis of a relationship between a timing of an end of processing of a predetermined quantity of photosensitive material and a timing at which the emptiness detecting mechanism detects the emptiness of the replenisher container in which a predetermined necessary and minimum quantity of the replenisher was accommodated for processing the predetermined quantity of photosensitive material; and a controlling mechanism for controlling the operation of the photographic processing apparatus.

In accordance with the above-described first aspect of the present invention, in the photographic processing apparatus in which the processing replenisher is replenished from the replenisher container to the processing tank in a quantity proportional to a quantity of a photosensitive material processed by being immersed in a processing solution, a predetermined necessary and minimum quantity of the replenisher is accommodated for processing a predetermined quantity of photosensitive material. Namely, it is possible to process a predetermined quantity of photosensitive material while replenishing a predetermined quantity of replenisher from the replenisher container. The replenisher supplying mechanism which is used for supplying the replenisher from the replenisher container to the processing tank is adjusted in such a manner as to be provided with a required function before the shipment of the photographic processing apparatus from a factory, so that the processing of a predetermined quantity of photosensitive material is to be naturally completed when all the replenisher in the replenisher container is supplied to the processing tank. However, the function (capability) of the replenisher supplying mechanism changes. Particularly, in the case of the replenisher supplying mechanism such as a pump which has been used over extended periods of time, it is conceivable that such a replenisher supplying mechanism is not provided with the required function. Accordingly, it is possible to determine the function of the replenisher supplying mechanism on the basis of which arrives earlier in time between the time of completion of the processing of a predetermined quantity of photosensitive material serving as a reference and the timing at which the replenisher in the replenisher container is used up.

In accordance with a second aspect of the present invention, in the photographic processing apparatus according to the above-described first aspect, if the emptiness detecting mechanism does not detect the empty state of the replenisher container upon completion of the processing of the predetermined quantity of the photosensitive material, the controlling mechanism drives the replenisher supplying mechanism in such a manner as to supply an entire quantity of replenisher remaining in the replenisher container forcibly to the processing tank.

The above-described second aspect of the invention concerns the state in which the function of the replenisher supplying mechanism has declined. The fact that the replenisher remains in the replenisher container upon completion of the processing of a predetermined quantity of photosensitive material means that the quantity of supply of replenisher in the processing conducted by then was smaller than a predetermined quantity of the replenisher to be supplied.

Therefore, by supplying all the remaining quantity of the replenisher to the processing tank, it is possible to set the state of the processing solution in the processing tank at that time in a favorable state in preparation for the ensuing processing of photosensitive material.

In accordance with a third aspect of the present invention, in the photographic processing apparatus according to the above-described second aspect, when the forcibly supplied quantity of replenisher has exceeded a predetermined quantity, the controlling mechanism displays a warning on a display unit of the photographic processing apparatus.

In accordance with the above-described third aspect of the invention, in a case where the forcibly supplied quantity of replenisher, i.e., the quantity of replenisher remaining in the replenisher container, is greater than a predetermined quantity, a determination is made that the function of the replenisher supplying means has declined to a degree exceeding an allowable range, so that a warning is issued to take some countermeasure on the photographic processing apparatus, thereby making it possible to inform an operator. For example, it urges the operator to replace or adjust the replenisher supplying means.

Meanwhile, in a case where the forcibly supplied quantity is smaller than the predetermined quantity, a determination is made that the function of the replenisher supplying mechanism is within the allowable range, and no warning is issued.

In accordance with a fourth aspect of the present invention, in the photographic processing apparatus according to the above-described second aspect, if the emptiness detecting mechanism has detected the empty state of the replenisher container, the controlling mechanism stops the driving of the replenisher supplying mechanism.

In accordance with the above-described fourth aspect of the invention, it is possible to stop the replenisher supplying mechanism which is driven for forcibly supplying the replenisher remaining in the replenisher container to the processing tank.

In accordance with a fifth aspect of the present invention, in the photographic processing apparatus according to the above-described second aspect, the controlling mechanism calculates the forcibly supplied quantity of replenisher on the basis of an operating time of the replenisher supplying mechanism until the emptiness detecting mechanism detects the empty state of the replenisher container.

In accordance with the above-described fifth aspect of the present invention, since a determination is made as to whether or not the quantity of replenisher remaining in the replenisher container is so large as to issue a warning, it is possible to ascertain the quantity of replenisher which has been forcibly supplied.

In accordance with a sixth aspect of the present invention, in the photographic processing apparatus according to the above-described first aspect, if the emptiness detecting mechanism has detected the emptiness before completion of the processing of the predetermined quantity of photosensitive material, the controlling mechanism displays a warning message on a display unit of the photographic processing apparatus.

The above-described sixth aspect of the invention concerns a measure for coping with a state in which the replenisher supplying mechanism has excessively operated beyond a predetermined level in a case where the replenisher container has become empty before the completion of the processing of a predetermined quantity of photosensitive material. This state indicates that an excess quantity of replenisher has been supplied to the processing tank. In this case, a determination is made that the function of the replenisher supplying mechanism has exceeded an allowable range, and a warning is issued, thereby making it possible to prompt an operator to replace or adjust the replenisher supplying mechanism.

In accordance with a seventh aspect of the present invention, in the photographic processing apparatus according to the above-described second aspect, when the emptiness detecting mechanism does not detect the empty state of the replenisher container upon completion of the processing of the predetermined quantity of photosensitive material, and after the entire quantity of replenisher remaining in the replenisher container is forcibly supplied to the processing tank, a warning message indicating that no replenisher remains in the replenisher container is displayed on a display unit.

In accordance with the above-described seventh aspect of the invention, it is possible to prompt the operator to replace the replenisher container with a new one in which a predetermined quantity of replenisher is accommodated, or to replenish a predetermined quantity of replenisher to the replenisher container.

In accordance with an eighth aspect of the present invention, there is provided a photographic processing apparatus in which a processing replenisher is replenished from a replenisher container to a processing tank in a quantity proportional to a quantity of a photosensitive material processed by being immersed in a processing solution, the photographic processing apparatus comprising: a replenisher supplying mechanism for supplying the replenisher from the replenisher container to the processing tank, the replenisher being accommodated in the replenisher container in a predetermined necessary and minimum quantity for processing a predetermined quantity of photosensitive material at a point of time of commencement of processing; a determining mechanism for determining a function of the replenisher supplying mechanism on the basis of a quantity of replenisher remaining when the processing of the predetermined quantity of photosensitive material has been completed; and a controlling mechanism for controlling the operation of the photographic processing apparatus.

In accordance with the above-described eighth aspect of the invention, since it is possible to ascertain the quantity of replenisher in the replenisher container upon completion of the processing of a predetermined quantity of photosensitive material, it is possible to evaluate the function of the replenisher supplying mechanism.

In accordance with a ninth aspect of the present invention, in the photographic processing apparatus according to the above-described second aspect, a plurality of pairs of the processing tank and the replenisher container for replenishing the replenisher to the processing tank are provided, and the replenishers remaining in all the replenisher containers are forcibly replenished to the respective processing tanks at the same time.

In accordance with the above-described ninth aspect of the invention, in a case where replenishers for processing solutions are respectively supplied from a plurality of replenisher containers to the processing tanks, all the replenisher containers are forcibly emptied upon completion of the processing of a predetermined quantity of photosensitive material. As a result, the replenisher containers can be emptied substantially at the same time, and the replenisher containers can be replaced by unused replenisher containers at the same time.

In accordance with a 10the aspect of the present invention, there is provided a photographic processing apparatus in which a processing replenisher is replenished to a processing tank in a quantity proportional to a quantity of a photosensitive material processed by being immersed in a processing solution, the photographic processing apparatus comprising: a replenisher container in which a necessary and minimum quantity of replenisher for processing a predetermined quantity of photosensitive material is sealed prior to starting the processing of the photosensitive material, the replenisher container being formed of a bag-shaped thin pliable sheet which is virtually oxygen impermeable; a photosensitive material detecting mechanism for detecting a processing quantity of the photosensitive material; a replenisher supplying mechanism for replenishing the replenisher from the replenisher container to the processing tank; a display unit for displaying a state of operation of the photographic processing apparatus; an emptiness detecting mechanism for detecting an empty state of the replenisher container by detecting a state of operation of the replenisher supplying mechanism; a determining mechanism for determining a function of the replenisher supplying mechanism by making a comparison of a point of time of completion of the processing of the predetermined quantity of photosensitive material and a point of time of detection of emptiness of the replenisher container by the emptiness detecting mechanism; and a controlling mechanism for controlling the operation of the photographic processing apparatus.

In accordance with the above-described 10th aspect of the invention, a necessary and minimum quantity of replenisher for processing a predetermined quantity of photosensitive material is sealed in the replenisher container, and the replenisher container is formed of a bagshaped thin pliable sheet which is virtually oxygen impermeable. As the replenisher is supplied from the replenisher container to the processing tank, the volume of the bag-shaped replenisher container decreases. Hence, the function of the replenisher supplying mechanism can be evaluated by the emptiness detecting mechanism on the basis of whether or not the replenisher container is empty upon completion of the processing of a predetermined quantity of photosensitive material.

In accordance with an 11th aspect of the present invention, in the photographic processing apparatus according to the above-described 10th aspect, if the emptiness detecting mechanism does not detect the empty state of the replenisher container upon completion of the processing of the predetermined quantity of photosensitive material, the controlling mechanism controls the replenisher supplying mechanism in such a manner that an entire quantity of replenisher remaining in the replenisher container is forcibly supplied to the processing tank, and that if the emptiness detecting mechanism has detected the empty state of the replenisher container, the controlling mechanism controls the replenisher supplying mechanism in such a manner as to stop the driving of the replenisher supplying mechanism.

In accordance with the above-described 11th aspect of the invention, the fact that the replenisher remains in the replenisher container upon completion of the processing of the predetermined quantity of photosensitive material means that the quantity of supply of replenisher in the processing conducted by then was smaller than the quantity of the replenisher to be supplied. Therefore, the replenisher supplying mechanism is controlled in such a manner as to supply all the remaining quantity to the processing tank so as to set the state of the processing solution in the processing tank in a favorable state. Further, the replenisher supplying mechanism is controlled in such a manner as to stop its driving upon completion of the supply of all the quantity of replenisher remaining in the replenisher container to the processing tank.

In accordance with a 12th aspect of the present invention, in the photographic processing apparatus according to the above-described 11th aspect, when the forcibly supplied quantity of the replenisher has exceeded a predetermined quantity, the controlling mechanism displays a warning message on a display unit of the photographic processing apparatus.

In accordance with the above-described 12th aspect of the invention, the fact that the forcibly supplied quantity of replenisher has exceeded a predetermined quantity means that the quantity of the replenisher supplied to the processing tank in the processing of the photosensitive material conducted by then was substantially small. Hence, a warning message is displayed on the display unit of the photographic processing apparatus, thereby informing an operator to take a countermeasure such as replacement or adjustment of the replenisher supplying mechanism.

In accordance with a 13th aspect of the present invention, in the photographic processing apparatus according to the above-described 11th aspect, the controlling mechanism calculates the forcibly supplied quantity of replenisher on the basis of an operating time of the replenisher supplying mechanism from the beginning of supply of the replenisher which is forcibly supplied until the emptiness detecting mechanism detects the empty state of the replenisher container, and wherein if the calculated quantity of replenisher has exceeded a predetermined quantity, the controlling mechanism displays a warning message on a display unit of the photographic processing apparatus.

In accordance with the above-described 13th aspect of the invention, the forcibly supplied quantity of replenisher is calculated on the basis of the operating time of the replenisher supplying mechanism from the beginning of supply of the replenisher until the emptiness detecting mechanism detects the empty state of the replenisher container. If this calculated quantity has exceeded a predetermined quantity, it means that the quantity of replenisher supplied in the processing of the photosensitive material carried out by then was substantially small. Hence, a warning message is displayed on the display unit of the photographic processing apparatus, thereby informing the operator to take a countermeasure such as replacement or adjustment of the replenisher supplying mechanism.

In accordance with a 14th aspect of the present invention, in the photographic processing apparatus according to the above-described 11th aspect, if the emptiness detecting mechanism has detected the emptiness of the replenisher container before completion of the processing of the predetermined quantity of a photosensitive material, the controlling mechanism displays a warning message on a display unit of the photographic processing apparatus.

In accordance with the above-described 14th aspect of the invention, if the replenisher container was empty before completion of the processing of the predetermined quantity of photosensitive material, and the replenisher was supplied in excess in the processing of the photosensitive material conducted by then, a determination is made that the function of the replenisher supplying mechanism has exceeded the allowable range, and the operator is informed of a need to take a countermeasure such as replacement or adjustment of the replenisher supplying mechanism.

In accordance with a 15th aspect of the present invention, in the photographic processing apparatus according to the above-described 11th aspect, a plurality of pairs of the processing tank and the replenisher supplying mechanism are provided, and the replenishers remaining respectively in the replenisher containers are forcibly supplied to the processing tanks, respectively, upon completion of the processing of the predetermined quantity of the photosensitive material.

In accordance with the above-described 15th aspect of the invention, by emptying the plurality of replenisher containers at the same time, it is possible to replace the replenisher containers with unused replenisher containers at the same time.

In accordance with a 16th aspect of the present invention, in the photographic processing apparatus according to the above-described 11th aspect, the replenisher supplying pump includes a bellows pump and a motor for driving the bellows pump, and the emptiness detecting mechanism detects the emptiness of the replenisher container on the basis of a change in a pulse width of an output pulse signal from a detector for detecting the operation of the bellows pump.

In accordance with the above-described 16th aspect of the invention, as for the pulse width of a pulse signal outputted from the detector for detecting the operation of the bellows pump, a signal of a fixed pulse width is outputted during the time when the replenisher is present in the replenisher container. However, when the replenisher runs out in the replenisher container, a load is applied to the pump, so that the pulse width expands. This makes it possible to detect that the replenisher has run out in the replenisher container (emptiness detection).

The above and other objects, features and advantages of the present invention will become more apparent from the following detailed description of the invention when read in conjunction with the accompanying drawings.

BRIEF DESCRIPTION OF THE DRAWINGS

FIGS. 4A through 4C are time charts illustrating pulse signals which are each outputted when an abnormality has occurred before completion of the processing of a predetermined quantity of photosensitive material, in which FIG. 4A shows a case where the emptiness of a development replenisher pack has been detected before the processing of the predetermined quantity of photosensitive material, FIG. 4B shows a case where the emptiness of a fixation replenisher pack has been detected, and FIG. 4C shows a case where the emptiness of both the development replenisher pack and the fixation replenisher pack has been detected; and FIGS. 5A through 5D are time charts illustrating pulse signals which are obtained from the quantities remaining in the development replenisher pack and the fixation replenisher pack after completion of the processing of a predetermined processing quantity, in which FIG. 5A shows a case where the emptiness of both the development replenisher pack and the fixation replenisher pack has been detected and the error is less than an equivalent of 100 films, FIG. 5B shows a case where only the emptiness of the development replenisher pack has been detected, FIG. 5C shows a case where only the emptiness of the fixation replenisher pack has been detected, and FIG. 5D shows a case where the emptiness of both the development replenisher pack and the fixation replenisher pack has not been detected and the error has exceeded an equivalent of 100 films.

DESCRIPTION OF THE PREFERRED EMBODIMENTS

Referring now to the accompanying drawings, a detailed description will be given of an embodiment of the present invention.

Figure 1:
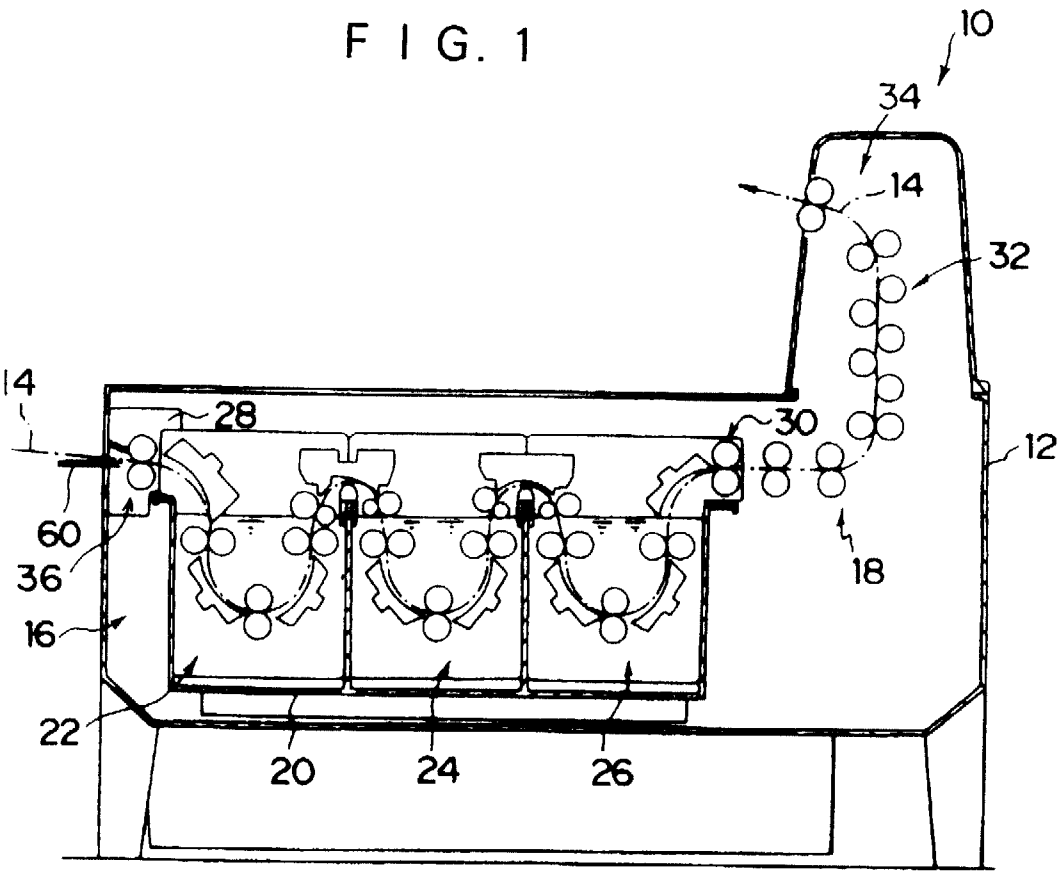
FIG. 1 is a schematic diagram of a photographic processing apparatus in accordance with the present invention.

FIG. 1 shows a schematic diagram of a photographic processing apparatus 10 in accordance with the present invention.

This photographic processing apparatus 10 is provided with a processing-solution processing section 16 in which sheet films 14, i.e., a sheet-like photosensitive material, are processed by being consecutively immersed in a plurality of processing solutions while being transported inside a box-shaped photographic processing apparatus body 12, as well as a drying section 18 in which the sheet films 14 processed in the processing-solution processing section 16 are subjected to dry processing.

The sheet films 14 are fed into the processing-solution processing section 16 by a pair of opposing rollers 36 at an insertion rack 28. In the vicinity of an inlet port of the insertion rack 28, a sensor is disposed which detects the width and length of the sheet film 14 to be processed (on detection of a leading end and a trailing end of the sheet film 14, the length can be calculated from the relationship between a time duration elapsed in the passage of the leading end and the trailing end and the transport speed of the sheet film 14), and is thereby capable of determining an area thereof.

A developing tank 22, a fixing tank 24, and a washing tank 26, in which a developer, a fixer, and washing water are respectively accommodated, are provided in a processing tank 20 inside the processing-solution processing section 16. In each tank, a transport passage for transporting the sheet films 14 is formed by a plurality of pairs of rollers and guides. The insertion rack 28 is provided upstream of the developing tank 22. In addition, a squeegeeing section 30 is disposed between the washing tank 26 and the drying section 18.

The sheet films 14, after having been drawn into the processing-solution processing section 16 by the insertion rack 28, pass the developing tank 22, the fixing tank 24, and the washing tank 26 along the transport passage, and are thereby processed by being consecutively immersed in the respective processing solutions. Then, while water attached to their surfaces is being squeegeed off in the squeegeeing section 30, the sheet films 14 are further transported and are fed into the drying section 18.

The drying section 18 is disposed at a position higher than the processing-solution processing section 16, and a transport passage for guiding the sheet films 14 in an upward direction is formed by a multiplicity of groups of rollers 32 which are arranged in a zigzag manner. Through such a structure, the sheet films 14 are dried while being transported in the upward direction by the groups of rollers 32.

The sheet films 14 which have been subjected to drying processing are discharged outside the apparatus above the processing-solution processing section 16 by means of a turning section 34 provided above the drying section 18.

Incidentally, in the processing-solution processing section 16, the sheet films 14 are processed by being transported in a state in which their photosensitive surface faces up (in a case where the photosensitive surface is formed on only one surface).

Figure 2B:
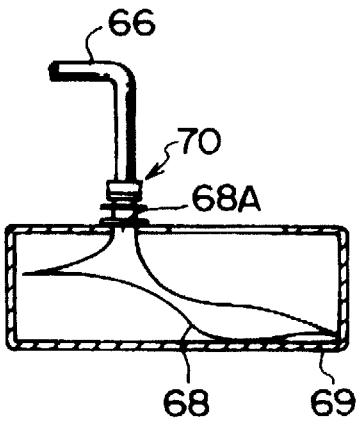
FIGS. 2A and 2B are schematic diagrams of a structure of the replenisher piping of the photographic processing apparatus in accordance with the present invention.
Figure 2A:
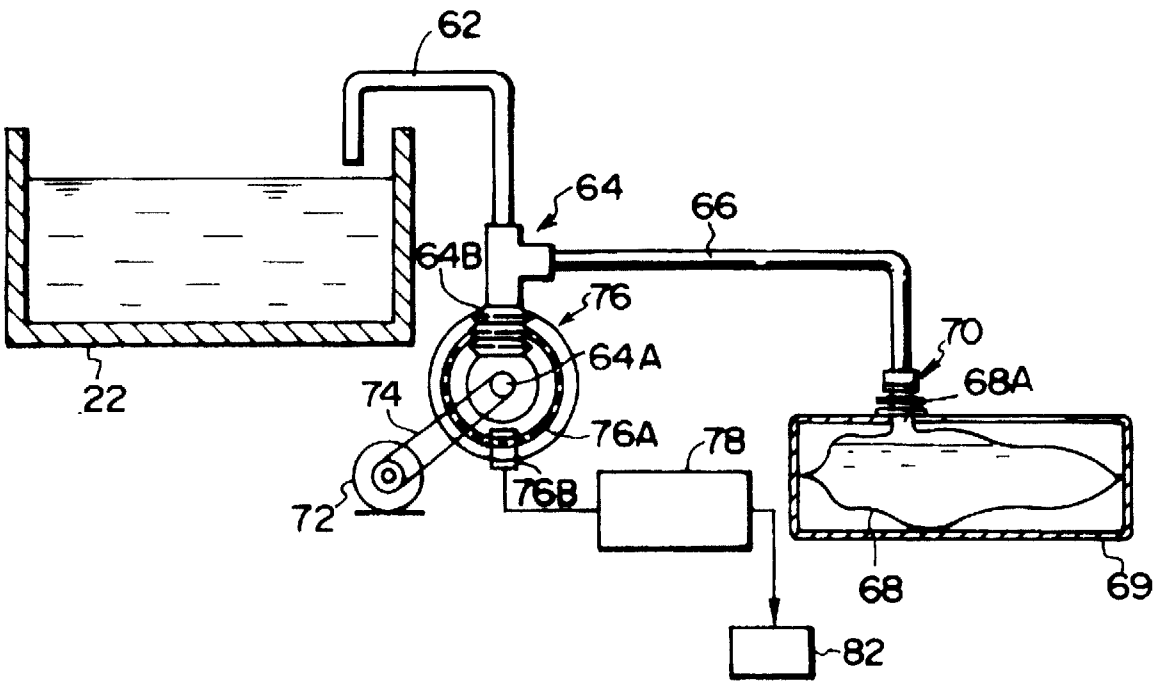

FIG. 2 shows the structure of a pipeline for replenishing replenishers to the developing tank 22 and the fixing tank 24 of the processing-solution processing section 16 in FIG. 1.

After completion of predetermined exposure, the sheet films 14 undergo processing in the order of development, fixation, and washing by the photographic processing apparatus 10 shown in FIG. 1. That is, the sheet films 14 are consecutively immersed in the respective processing tanks, the developing tank 22, the fixing tank 24, and the washing tank 26, are then subjected to dry processing by the drying section 18, and are discharged outside the photographic processing apparatus 10.

Evidently, the processing solutions in the processing tanks become deteriorated each time the sheet film 14 is processed. As a method for replenishing them, packs of replenishers corresponding to the respective processing solutions in the developing tank 22 and the fixing tank 24 are loaded in the photographic processing apparatus 10, and replenishers in quantities proportional to quantities of the film to be processed are supplied to the respective processing tanks, when necessary. To ensure that the processing solutions to be replenished do not change in quality due to air in the atmosphere, it is required that the replenishers in the replenisher packs are always isolated from the air. Hence, when the replenisher in the replenisher pack has become empty, it is necessary to replace the replenisher pack immediately.

The replenisher packs which are subject to replacement in this embodiment include two kinds of replenisher packs, i.e., a development replenisher pack in which a development replenisher is sealed and a fixation replenisher pack in which a fixation replenisher is sealed. The two packs are shrinkable bag-shaped containers made of a synthetic resin for maintaining the respective replenishers in a state of being isolated from the air.

In this embodiment, a description will be given by citing as an example the structure of the piping through which the development replenisher is replenished from a development replenisher pack 68 to the developing tank 22, as shown in FIG. 2. Since the piping structure for the fixing tank 24 is similar to that for the developing tank 22, a description thereof will be omitted.

As shown in FIG. 2, one end of a pipe 62 is open above the developing tank 22. The other end of this pipe 62 is connected to a discharge port of a belows pump 64. One end of a pipe 66 is connected to a suction port of the bellows pump 64.

A joint 70 which can be connected to a discharge port 68A of the development replenisher pack 68 is attached to, the other end of the pipe 66.

The development replenisher pack 68 is accommodated in a box-shaped case 69 formed of a corrugated cardboard or the like, and a development replenisher is sealed in the development replenisher pack 68, which is formed in the shape of a bag by bonding together thin soft sheets made of a synthetic resin having small oxygen permeability such as polyvinyl chloride, in a state in which practically no air is contained. The development replenisher pack 68 is deformable from the state shown in FIG. 2A to the state shown in FIG. 2B. Since its replenisher discharge port 68A is accommodated in the case 69, the deformable development replenisher pack 68 is adapted to be held at a predetermined position even if its shape has changed. Further, the discharge port 68A of the development replenisher pack 68 is connected to the aforementioned pipe 66 by means of the joint 70 attached to an end portion of the pipe 66. In addition, the joint 70 is adapted to maintain the interior of the development replenisher pack 68 in a hermetically sealed state until the discharge port 68 is coupled to the pipe 66, and the discharge port 68A and the pipe 66 are adapted to communicate with each other upon completion of the jointing. Hence, the arrangement provided is such that the development replenisher is prevented from becoming deteriorated due to the leakage of the development replenisher from this discharge port 68A or due to the entry of air into the development replenisher pack 68.

As for the development replenisher pack 68, in a case where it is detected that the development replenisher has been used up (emptiness detection), the case 69 is replaced in its entirety. Since the bag-shaped container of the development replenisher pack 68 is pliable, the used development replenisher pack 68 is not bulky, so that the pack is easy to recover.

The bellows pump 64 receives a driving force of a motor 72 by means of a shaft 64A via a belt 74. As a bellows portion 64B is driven in such a manner as to extend and retract by the rotation of a cam which is rotated by means of the shaft 64A, the bellows pump 64 sucks the development replenisher in the development replenisher pack 68 from its suction port through the pipe 66, and discharges it from its discharge port, thereby making it possible to replenish the development replenisher to the developing tank 22 through the pipe 62.

The quantity of development replenisher replenished to the developing tank 22 is determined by the number of times of extension and retraction of the bellows pump 64, i.e., the driving time of the motor 72. In this embodiment, if the motor 72 is driven for a predetermined unit time, the bellows portion 64B of the bellows pump 64 extends and retracts, whereby a fixed quantity, e.g., 20 cc, of the development replenisher is replenished. Accordingly, since the rotating speed of the motor 72 is considered to be normally fixed, if the driving time of the motor 72 is controlled by a multiple of the unit time, the quantity of supply of the replenisher by the bellows pump 64 (the quantity of development replenisher replenished to the developing tank 22) can be determined by a multiple of 20 cc. In a case where the development replenisher is supplied at a time interval, the quantity of development replenisher replenished from a new development replenisher pack 68 to the developing tank 22 after connection of the development replenisher pack 68 to the pipe 66 can be summed on the basis of the number of drivings of the motor 72. Incidentally, the 20 cc of development replenisher corresponds to a quantity which is replenished for processing a film quantity corresponding to four sheet films of the 10×12 inch size. Since the bellows pump 64 cannot accurately supply a small quantity of liquid, the bellows pump 64 is driven with the driving time of the motor 72 as a unit time in such a manner as to supply 20 cc at a time to the developing tank 22.

To detect the number of revolutions of the motor 72, a pulse encoder 76 is provided for the bellows pump 64. A rotating plate of the pulse encoder 76 is attached to the shaft 64A of the bellows pump 64, and is adapted to rotate simultaneously with the rotation of the shaft 64A. An identifying portion 76A, on which a white color and a black color are alternately coated, is provided in the vicinity of an outer periphery of the rotating plate of the pulse encoder 76. Further, a photosensor 76B of a reflecting type is provided in face-to-face relation to the identifying portion 76A so as to detect the white color and the black color of the identifying portion 76A of the rotating plate of the pulse encoder 76 which rotates simultaneously with the rotation of the shaft 64B.

Figure 4A:
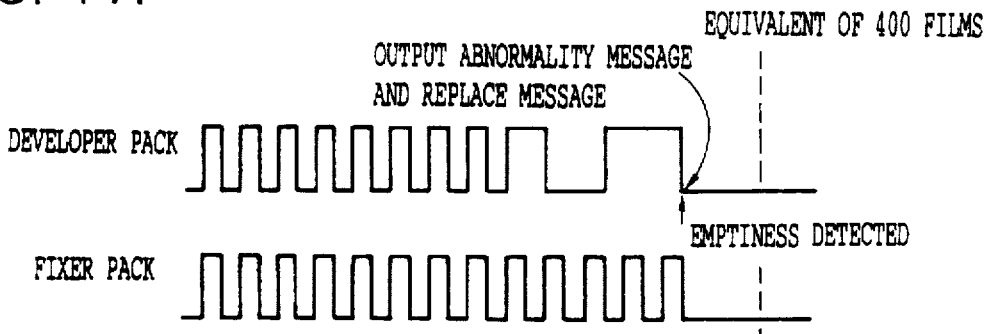
Figure 4B:
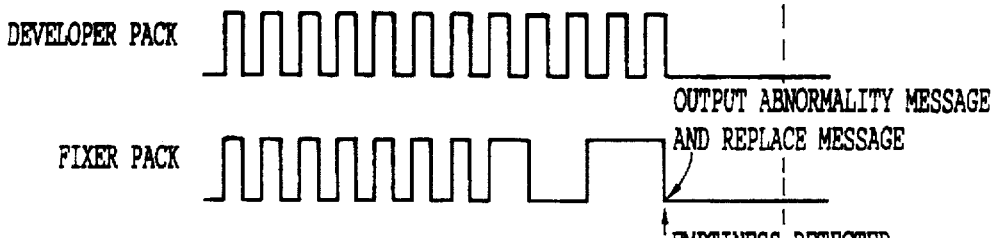
Figure 4C:
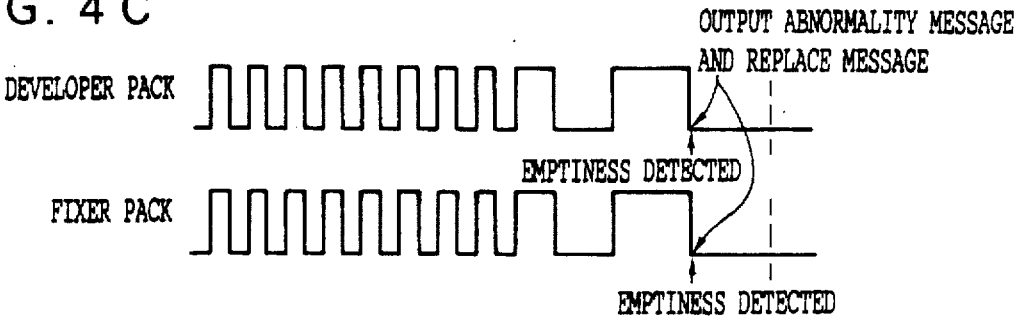

The photosensor 76B is electrically connected to a control unit 78, and is adapted to supply to the control unit 78 a low-level signal representing a low reflectance from the black color of the identifying portion 76A and a high-level signal representing a high reflectance from the white color (a pulse signal such as the one shown in FIG. 4 or 5). By virtue of such a structure, the control unit 78 is capable of monitoring the rotating state of the motor 72.

Next, a description will be given of a specific method for replenishing the development replenisher by controlling the driving of the motor 72.

The quantity (area) of film which has passed the sensor is detected by the sensor disposed in the vicinity of the insertion rack 28, the motor 72 is driven corresponding to the same to operate the bellows pump 64, and the development replenisher is sucked from the development replenisher pack 68 so as to be supplied to the developing tank 22. For instance, when the motor 72 is started and is then stopped after a unit time, 20 cc of the development replenisher, which is a minimum replenishing unit of supply, is replenished to the developing tank 22 during the driving of the motor 72. The number of unit times of driving the motor 72 after replacement of the development replenisher pack 68 with a new one is summed, and a comparison is made between that value and an expected number of unit times necessary for sucking the entire predetermined quantity of development replenisher in the new development replenisher pack 68. On the basis of this comparison, the following control is carried out.

The quantity of development replenisher which is sealed in the new (unused) development replenisher pack 68 is set to a quantity necessary for processing a predetermined quantity of film, i.e., such a quantity that when the processing of the predetermined quantity of film is completed, the quantity of development replenisher in the development replenisher pack 68 becomes zero (empty). For example, each time the sensor in the vicinity of the insertion rack 28 detects films of a processing quantity corresponding to four sheet films of the 10×12 inch size, the motor 72 is driven to operate the bellows pump 64, thereby supplying the minimum replenishing unit of 20 cc of development replenisher to the developing tank 22. For this reason, if it is assumed that the development replenisher of a necessary and minimum quantity for processing sheet films corresponding to 400 sheet films of the 10×12 inch size is filled in one development replenisher pack 68, it follows that the quantity of development replenisher sealed in the development replenisher pack 68 is 2 liters.

In a state in which all the development replenisher has been supplied from the development replenisher pack 68 to the developing tank 22 and its quantity has become zero (empty), the interiors of the development replenisher pack 68 and the pipe 66 assume a negative pressure due to the operation of the bellows pump 64, so that the load of the motor 72 for reciprocatingly driving the bellows pump 64 becomes large. Hence, the control unit 78 is able to ascertain the emptiness by detecting that the pulse width of the developing tank 22 and its quantity has become zero (empty), the interiors of the development replenisher pack 68 and the pipe 66 assume a negative pressure due to the operation of the bellows pump 64, so that the load of the motor 72 for reciprocatingly driving the bellows pump 64 becomes large. Hence, the control unit 78 is able to ascertain the emptiness by detecting that the pulse width of a signal outputted from the pulse encoder 76 has become larger than that during a steady state.

The emptiness of the replenisher pack 68 can also be detected by monitoring that the driving current of the motor 72 exceeds a predetermined threshold value, since the load of the motor 72 becomes abruptly large when the replenisher pack 68 becomes empty.

Further, in a case where the development replenisher still remains in the development replenisher pack 68 despite the fact that the processing of a quantity corresponding to 400 films of the 10×12 inch size has been carried out after replacement of the development replenisher pack 68 with a new one (i.e., the control unit 78 does not detect that the interior of the development replenisher pack 68 has become empty), the control unit 78 forcibly supplies the remaining development replenisher to the developing tank 22 by continuously driving the motor 72. If the function of the bellows pump 64 were normal, the development replenisher in the development replenisher pack 68 would be used up upon completion of the processing of films corresponding to, for example, 400 films of the 10×12 inch size, and the development replenisher would not be left in the development replenisher pack 68. On the other hand, the fact that the development replenisher remained means that the function of the bellows pump 64 declined, so that the entire quantity of development replenisher remaining in the development replenisher pack 68 is forcibly supplied on the ground that the summed quantity of development replenisher replenished to the developing tank 22 was insufficient.

In the above-described manner, the control unit 78 stops the motor 72 and finishes the forcible replenishment when it detects that the development replenisher has been used up or when it detects the emptiness of the interior of the development replenisher pack 68 by means of its timing or the like. The control unit 78 also has the function of determining whether or not the time for replacement of the development replenisher pack 68 has arrived and whether the degree of decline in the function of the bellows pump 64 indicates a failure or is in an allowable range, and has the function of displaying them on a display unit 82 on the outer surface of the photographic processing apparatus body 12.

For example, at the time when the development replenisher remained in the development replenisher pack 68 due to a decline in the function of the bellows pump 64 and the remaining development replenisher is forcibly supplied, the quantity to be forcibly supplied can be determined from the summed quantity of replenished development replenisher which is calculated from the number of unit times of driving the motor 72 which is driven until the emptiness detection. If the quantity of this forcible replenishment is not more than the quantity of development replenisher necessary for replenishment for processing a film quantity corresponding to 100 films of the 10×12 inch size, it is assumed that the decline in the function of the bellows pump 64 is within an allowable range, and a message on an abnormality such as a failure is not displayed on the display unit 82, and only a "replace message" prompting the replacement of the development replenisher pack 68 is displayed.

In addition, in a case where the emptiness of the development replenisher pack 68 is detected before the quantity of processed film reaches an equivalent of 400 films of the 10×12 inch size, and in a case where the quantity of forcible replenishment has exceeded a quantity of development replenisher necessary for replenishment for processing a film quantity corresponding to 100 films of the 10×12 inch size, an "abnormality message" is displayed on the display unit 82, indicating that there is an abnormality in the apparatus including the bellows pump 64 or in operation of the apparatus.

Although a description has been given in the above of the development replenisher and the development replenisher pack 68, similar arrangements are adopted for the fixation replenisher and its pack, i.e., the fixation replenisher pack.

Figure 3:
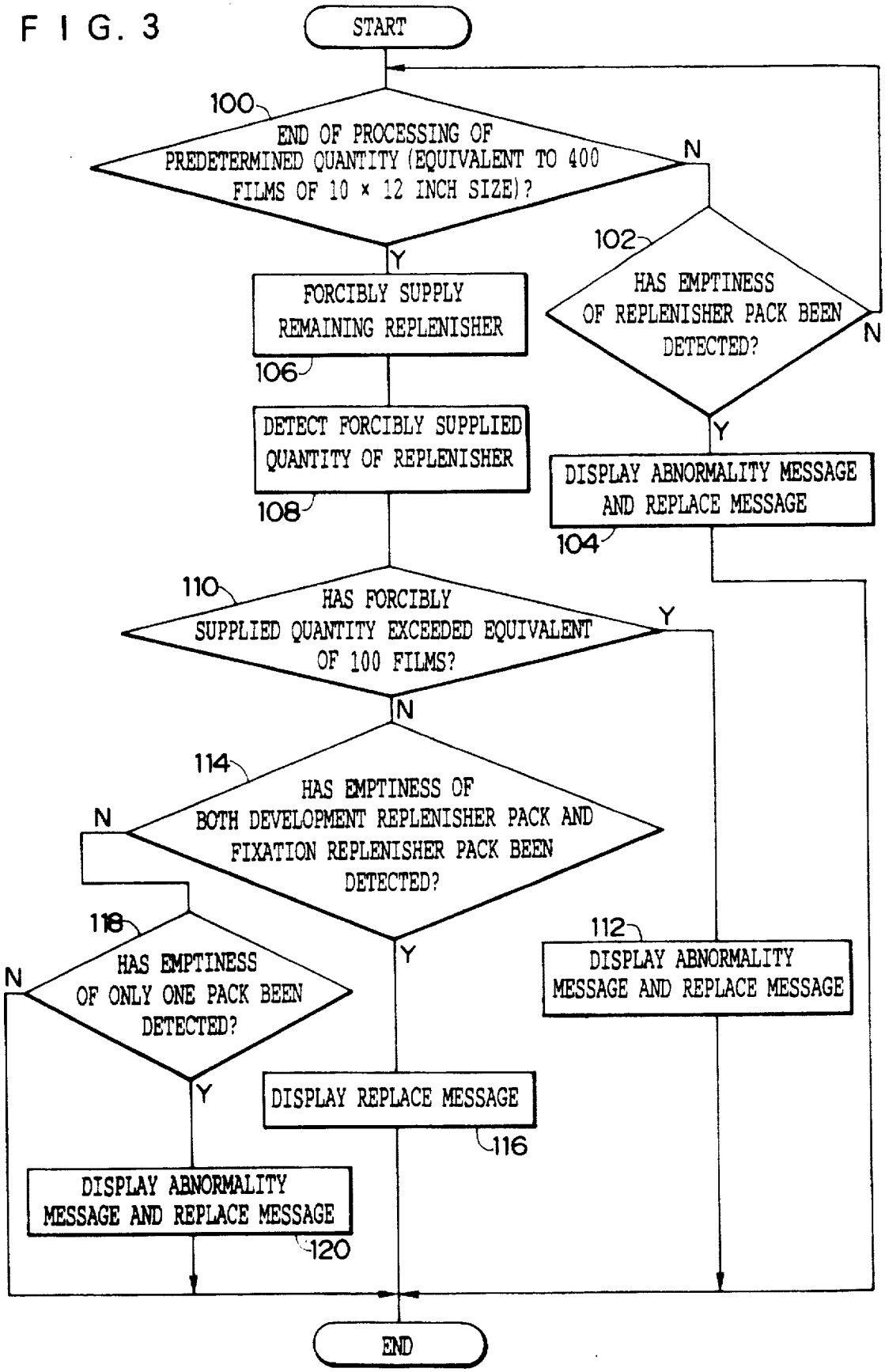
FIG. 3 is a flowchart illustrating a control routine concerning the replacement of replenisher packs of the photographic processing apparatus in accordance with the present invention.

Next, a description will be given of the operation in accordance with this embodiment with reference to the flowchart shown in FIG. 3.

The flow of operation shown in this flowchart is started simultaneously with the starting of the processing by the photographic processing apparatus 10, and is repeatedly executed until the replace message or the abnormality message is outputted for the development replenisher pack 68.

Hereafter, a description will be given by citing as an example the structure for replenishment from the development replenisher pack 68 to the developing tank 22, but similar processing is effected in parallel with respect to the fixation replenisher pack as well.

First, in Step 100, a determination is made as to whether or not the processing of the sheet films 14 (corresponding to 400 sheets of the 10×12 inch size) has been finished. This determination can be made on the basis of the signal representing the summation of areas of the films which have passed the unillustrated sensor disposed in the vicinity of the insertion rack 28.

Here, if it is determined that the processing of the predetermined processing quantity has not been finished, the operation proceeds to Step 102 to detect whether or not the development replenisher in the development replenisher pack 68 has been used up.

Hereafter, a description will be given of a method for detecting the emptiness of the development replenisher pack 68, i.e., whether or not the development replenisher still remains. This determination is made on the basis of whether or not the development replenisher pack 68 and the pipe 66 are in a state of vacuum. That is, an arrangement is provided to detect that the width of the pulse signal which is outputted by the identifying portion 76A of the pulse encoder 76, which rotates with the rotation of the motor 72 for reciprocatingly driving the bellows pump 64, has become large.

As the motor 72 rotates, the rotating plate of the pulse encoder 76 rotates, and the driving force is transmitted to the bellows pump 64, so that the development replenisher is sucked from the development replenisher pack 68 via the pipe 66. At this time, since the load is small while a sufficient quantity of development replenisher remains in the development replenisher pack 68, the pulse signal detected by the photosensor 76B is outputted with a fixed pulse width.

On the other hand, when the remaining quantity of development replenisher in the development replenisher pack 68 has become small, if an attempt is made to supply the development replenisher further, the interior of the pipe 66 assumes a state of vacuum, so that a load is applied to the bellows pump 64. The number of revolutions of the shaft 64A is reduced due to this load, with the result that the pulse width obtained from the pulse encoder 76 becomes broad. Upon detecting that this pulse width has become broader than a predetermined time duration, the control unit 78 outputs to the display unit 82 a signal representing that no development replenisher remains in the development replenisher pack 68 (emptiness detection). If the emptiness is detected, the driving of the motor 72 is stopped.

In the case where it is thus detected that no development replenisher remains in the development replenisher pack 68 despite the fact that the processing quantity of sheet film 14 has not reached a predetermined processing quantity (a film quantity corresponding to the quantity of development replenisher sealed in advance in the development replenisher pack 68) (see FIG. 4A), the driving of the motor 72 is stopped. Then, in Step 104, a message indicating an abnormality as well as a message for replacing the development replenisher pack 68 are displayed. Although, in this embodiment, a description is given by citing the development replenisher pack 68 by way of example, since similar processing is being carried out with respect to the fixation replenisher pack as well, also in a case where the fixation replenisher pack has become empty (see FIG. 4B) or both the development replenisher pack 68 and the fixation replenisher pack have become empty at the same time (see FIG. 4C), the driving of the motor 72 is stopped, and the messages are similarly displayed on the display unit 82 in Step 104.

As a cause for the display of the abnormality message, it is considered that the quantity of development replenisher used in the processing of a quantity of sheet film 14 corresponding to four films of the 10×12 inch size has been supplied in a quantity greater than the predetermined quantity (20 cc) due to a change in the performance of the bellows pump 64 or a change in its driving. In such a case, it is conceivable that the bellows pump 64, the pulse encoder 76, or the control unit 78 may be abnormal.

Meanwhile, before it is detected that no development replenisher remains in the development replenisher pack 68 (empty), if it is determined in Step 100 that the processing of the predetermined quantity of sheet film 14 has been finished, the operation proceeds to Step 106.

In Step 106, the bellows pump 64 is driven to forcibly supply the entire quantity of development replenisher remaining in the development replenisher pack 68 to the developing tank 22. The motor 72 is driven until the emptiness of the development replenisher pack 68 is detected. This emptiness detection is effected in the same way as in Step 102, and the driving of the motor 72 is stopped. Essentially, since 2 liters of development replenisher is sealed in the development replenisher pack 68, it is desirable that the development replenisher in the development replenisher pack 68 is used up when the processing of a film quantity corresponding to 400 films of the 10×12 inch size, i.e., the predetermined processing quantity, is completed since 20 cc of development replenisher is used for processing a film quantity corresponding to four films of the 10×12 inch size. However, since a change has occurred in the function of the bellows pump 64, the development replenisher remains in the development replenisher pack 68. Since this is due to the fact that the quantity of replenisher replenished to the developing tank 22 was small, that remaining portion is replenished to the developing tank 22, and when the predetermined processing quantity has been processed, it is assumed that a proper quantity of replenisher has been supplied.

In Step 108, the quantity of development replenisher remaining in the development replenisher pack 68 is detected. For this reason, the number of sheet films 14 corresponding to the quantity of replenisher forcibly supplied after the processing of the predetermined processing quantity is calculated on the basis of the signal outputted from the pulse encoder 76 as the bellows pump 64 driven for forcible replenishment is operated.

The method of the aforementioned calculation is similar to the calculating method described in Step 100, and the quantity of development replenisher replenished to the developing tank 22 can be determined by detecting the number of revolutions of the motor 72. Consequently, it is possible to detect how many sheet films 14 the quantity of forcible replenishment corresponds to in calculation.

In addition, it is also possible to detect the quantity remaining in the development replenisher pack 68 through the operating time of the motor 72 for forcible replenishment until the emptiness detection.

Subsequently, in Step 110, a determination is made as to whether the development replenisher remaining in the development replenisher pack 68 has exceeded an amount equivalent to 100 films of the 10×12 inch size after the processing of a predetermined processing quantity of films. That is, since 20 cc of development replenisher is required for four films of the 10×12 inch size, a determination is made as to whether or not 500 cc or more of the development replenisher remains. Accordingly, in this embodiment, in terms of the error when the quantity of replenishment by the replenisher replenishing system is small, an upper limit of an allowable range of the remaining quantity of development replenisher is set to be an equivalent of 100 films with respect to the predetermined processing quantity (corresponding to 400 films of the 10×12 inch size) which can be processed by one replenisher pack. That is, the normal condition is set such that even after the processing of the predetermined processing quantity (corresponding to 400 films of the 10×12 inch size), the replenisher remains in a quantity which is smaller than the quantity of replenisher (500 cc) corresponding to a predetermined quantity of film (corresponding to 100 films of the 10×12 inch size).

Here, in a case where the remaining quantity of development replenisher has exceeded the quantity for processing an equivalent of 100 films of the 10×12 inch size, that is, if the emptiness of the development replenisher pack 68 is not detected up to the processing of an equivalent of 100 films after the detection of an equivalent of 400 films, as shown in FIG. 5D, it is considered that some abnormality has occurred to the system of replenishing the replenisher in the same way as in Step 104. Therefore, in Step 112, the abnormality message is displayed, and the message for replacing the development replenisher pack 68 is also displayed. As a cause of this phenomenon, it is possible to cite the fact that the quantity of development replenisher used in the processing of an equivalent of four films of the 10×12 inch size was smaller than the predetermined quantity (20 cc) due to a decline in the function of the bellows pump 64.

In the above, a description has been given of a case where the development replenisher is sealed in the development replenisher pack 68 and is replenished to the developing tank 22 to effect development processing. However, similar processing is effected in parallel with respect to the fixing tank 24 as well.

Accordingly, if it is determined in Step 110 that both the remaining quantity of development replenisher and the remaining quantity of fixation replenisher are not more than equivalents of 100 films of the 10×12 inch size, a determination is made in Step 114 as to whether the development replenisher in the development replenisher pack 68 and the fixation replenisher in the fixation replenisher pack have been used up. Since the method of this detection is similar to the method described in Step 102, a description thereof will be omitted.

Here, if the emptiness is detected with respect to the replenisher packs of the development replenisher and the fixation replenisher as shown in FIG. 5A, the message for replacing the respective replenisher packs is displayed on the display unit 82 in Step 116.

Meanwhile, a determination is made in Step 118 as to whether the emptiness has been detected for either one of the development replenisher pack in which the development replenisher is sealed or the fixation replenisher pack in which the fixation replenisher is sealed. This is the case where a pulse signal such as the one shown in FIG. 5B or 5C has been obtained.

In the case where the emptiness is thus detected with respect to either one of the replenisher packs, it is conceivable that an abnormality has occurred in the replenisher replenishing system for which the emptiness was not detected.

Accordingly, in Step 120, the message for replacing the replenisher pack is displayed on the display unit 82, and the abnormality message is also displayed at the same time. Here, as a cause for the fact that the abnormality message is issued, it is conceivable that the replenisher has remained in the replenisher pack since the replenishing quantity of replenisher from the replenisher pack to the relevant processing tank was smaller than the predetermined quantity.

When the message for replacing the replenisher pack is displayed on the display unit 82 in Step 116 or 120, and the processing in accordance with this flowchart ends and the driving of the motor 72 is stopped, the operator confirms the details displayed on the display unit 82, removes the joint 70, and removes the replenisher pack in which the replenisher has been used up. Then, in place of the removed replenisher pack, the operator connects a new replenisher pack to the joint 70 via the discharge port 68A. Thus, the replacement of the replenisher pack is completed.

In the above-described manner, even if the replenisher pack is not provided with a level sensor or the like for detecting the remaining quantity of replenisher, it is possible to detect whether or not the replenisher remains in the replenisher pack by detecting the number of revolutions of the motor 72 and on the basis of the state of load applied to the bellows pump 64 which is operated by the driving of the motor 72.

Further, in a case where the remaining quantity of replenisher is in the allowable range in which the supply of the replenisher is considered to be normal, if the replenisher is forcibly supplied in such a manner as to correct a change in the quantity of replenisher supplied by the bellows pump 64 with respect to a predetermined processing quantity, it is possible to prompt the replacement of the plurality of replenisher packs loaded in the photographic processing apparatus 10 so as to replace the replenisher packs with new ones at the same time. Concurrently, it is possible to detect at an early period any abnormality in the main body of the photographic processing apparatus 10 or in the operation in the processing steps. Accordingly, it is possible to stabilize the concentrations of processing solutions in the processing tanks.

It should be noted that, although in this embodiment a description has been given by citing as an example the arrangement in which the message for replacing the replenisher pack and the message on the abnormality in the main body of the photographic processing apparatus 10 are displayed on the display unit 82, the present invention is not limited to the same. For instance, these messages may be alternatively transmitted by an audio output device such as a loudspeaker.

Further, although the identifying portion 76A provided on the rotating plate of the pulse encoder 76 for detecting the number of revolutions of the motor 72 is formed with a white color and a black color, and a pulse signal is arranged to be obtained by detecting the light reflected therefrom, an arrangement may be provided such that slits are provided in the identifying portion so as to obtain a pulse signal depending on whether or not the light is transmitted therethrough. Still further, an arrangement may be provided such that notches may be provided in the outer periphery of the rotating plate so as to obtain a pulse signal.

Further, although in this embodiment an arrangement is provided such that the rotatively driving force of the motor 72 is transmitted to the shaft 64A by means of the belt 74 so as to drive the bellows pump 64, an arrangement may be provided such that the belt 74 is not used for transmitting the rotatively driving force of the motor 72 and the rotating shaft of the motor 72 is directly coupled to the shaft 64A of the bellows pump 64.

In the above-described embodiment, to detect the processing quantity of sheet film 14, a summed quantity of processed film areas is determined by an unillustrated film detection sensor (such as the one provided at the insertion rack 28), and the processing quantity is determined from the summed quantity and the area of the film of the 10×12 inch size. However, the present invention is not limited to the same, and an arrangement may be provided such that the number of revolutions of the motor 72 and the quantity of replenisher necessary for processing a film quantity corresponding to four films of the 10×12 inch size are made to correspond to each other in advance, and the processing quantity is calculated by detecting the number of revolutions of the motor 72.

Further, various numerical values referred to in the above-described embodiment, including 2 liters as the content of the replenisher pack, 400 films as the predetermined processing quantity, and 20 cc as the quantity of replenisher used for processing an equivalent of four films of the 10×12 inch size, are not limited to the same.

As described above, in the replacement of replenisher packs in the photographic processing apparatus in accordance with the present invention, replenisher packs which are not provided with sensors for detecting the liquid levels are loaded in the apparatus, and the replenisher remaining when a predetermined processing quantity has been reached is forcibly supplied for replenishment, thereby supplying the remaining quantity of replenisher resulting from a decline in the function of the pump. Hence, it is possible to obtain a outstanding advantage that a plurality of replenisher packs can be replaced at the same time.

Further, since the containers each containing a replenisher sealed in are replaced, the replenishers do not undergo deterioration due to contact with the air until the replenishers are used up. Accordingly, the quantities of replenishers to be replenished can be minimum quantities.

What is claimed is:

1. A photographic processing apparatus in which a processing replenisher is replenished from a replenisher container to a processing tank in a quantity proportional to a quantity of a photosensitive material processed by being immersed in a processing solution, said photographic processing apparatus comprising:

an emptiness detecting mechanism for detecting an empty state of said replenisher container;

a replenisher supplying mechanism for replenishing the replenisher from said replenisher container to said processing tank;

a determining mechanism for determining a function of said replenisher supplying mechanism on the basis of a relationship between a timing of an end of processing of a predetermined quantity of photosensitive material and a timing at which said emptiness detecting mechanism detects the emptiness of said replenisher container in which a predetermined necessary and minimum quantity of the replenisher was accommodated for processing the predetermined quantity of photosensitive material; and a controlling mechanism for controlling the operation of said photographic processing apparatus.

2. A photographic processing apparatus according to claim 1, wherein if said emptiness detecting mechanism does not detect the empty state of said replenisher container upon completion of the processing of the predetermined quantity of photosensitive material, said controlling mechanism drives said replenisher supplying mechanism in such a manner as to supply an entire quantity of replenisher remaining in said replenisher container forcibly to said processing tank.

3. A photographic processing apparatus according to claim 2, wherein when the forcibly supplied quantity of replenisher has exceeded a predetermined quantity, said controlling mechanism displays a warning message on a display unit of said photographic processing apparatus.

4. A photographic processing apparatus according to claim 2, wherein if said emptiness detecting mechanism has detected the empty state of said replenisher container, said controlling mechanism stops the driving of said replenisher supplying mechanism.

5. A photographic processing apparatus according to claim 2, wherein said controlling mechanism calculates the forcibly supplied quantity of replenisher on the basis of an operating time of said replenisher supplying mechanism until said emptiness detecting mechanism detects the empty state of said replenisher container.

6. A photographic processing apparatus according to claim 1, wherein if said emptiness detecting mechanism has detected the emptiness before completion of the processing of the predetermined quantity of photosensitive material, said controlling mechanism displays a warning message on a display unit of said photographic processing apparatus.

7. A photographic processing apparatus according to claim 2, wherein if said emptiness detecting mechanism does not detect the empty state of said replenisher container upon completion of the processing of the predetermined quantity of photosensitive material, and after the entire quantity of replenisher remaining in said replenisher container is forcibly supplied to said processing tank, a warning message indicating that no replenisher remains in said replenisher container is displayed on a display unit.

8. A photographic processing apparatus in which a processing replenisher is replenished from a replenisher container to a processing tank in a quantity proportional to a quantity of a photosensitive material processed by being immersed in a processing solution, said photographic processing apparatus comprising:

a replenisher supplying mechanism for supplying the replenisher from said replenisher container to said processing tank, the replenisher being accommodated in said replenisher container in a predetermined necessary and minimum quantity for processing a predetermined quantity of photosensitive material at a point of time of commencement of processing;

a determining mechanism for determining a function of said replenisher supplying mechanism on the basis of a quantity of replenisher remaining when the processing of the predetermined quantity of photosensitive material has been completed; and a controlling mechanism for controlling the operation of said photographic processing apparatus.

9. A photographic processing apparatus according to claim 2, wherein a plurality of pairs of said processing tank and said replenisher container for replenishing the replenisher to said processing tank are provided, and the replenishers remaining in all the replenisher containers are forcibly supplied for replenishment at the same time.

10. A photographic processing apparatus in which a processing replenisher is replenished to a processing tank in a quantity proportional to a quantity of a photosensitive material processed by being immersed in a processing solution, said photographic processing apparatus comprising:

a replenisher container in which a necessary and minimum quantity of replenisher for processing a predetermined quantity of photosensitive material is sealed prior to starting the processing of the photosensitive material, said replenisher container being formed of a bag-shaped thin pliable sheet which is virtually oxygen impermeable;

a photosensitive material detecting mechanism for detecting a processing quantity of the photosensitive material;

a replenisher supplying mechanism for replenishing the replenisher from said replenisher container to said processing tank;

a display unit for displaying a state of operation of said photographic processing apparatus;

an emptiness detecting mechanism for detecting an empty state of said replenisher container by detecting a state of operation of said replenisher supplying mechanism;

a determining mechanism for determining a function of said replenisher supplying mechanism by making a comparison of a point of time of completion of the processing of the predetermined quantity of photosensitive material and a point of time of detection of emptiness of said replenisher container by said emptiness detecting mechanism; and a controlling mechanism for controlling the operation of said photographic processing apparatus.

11. A photographic processing apparatus according to claim 10, wherein if said emptiness detecting mechanism does not detect the empty state of said replenisher container upon completion of the processing of the predetermined quantity of photosensitive material, said controlling mechanism controls said replenisher supplying mechanism in such a manner as to supply an entire quantity of replenisher remaining in said replenisher container forcibly to said processing tank, and wherein if said emptiness detecting mechanism has detected the empty state of said replenisher container, said controlling mechanism controls said replenisher supplying mechanism in such a manner as to stop the driving of said replenisher supplying mechanism.

12. A photographic processing apparatus according to claim 11, wherein when the forcibly supplied quantity of replenisher has exceeded a predetermined quantity, said controlling mechanism displays a warning message on a display unit of said photographic processing apparatus.

13. A photographic processing apparatus according to claim 11, wherein said controlling mechanism calculates the forcibly supplied quantity of replenisher on the basis of an operating time of said replenisher supplying mechanism from a start of supply of the replenisher which is forcibly supplied until said emptiness detecting mechanism detects the empty state of said replenisher container, and wherein if the calculated quantity of replenisher has exceeded a predetermined quantity, said controlling mechanism displays a warning message on a display unit of said photographic processing apparatus.

14. A photographic processing apparatus according to claim 11, wherein if said emptiness detecting mechanism has detected the emptiness of said replenisher container before completion of the processing of the predetermined quantity of photosensitive material, said controlling mechanism displays a warning message on a display unit of said photographic processing apparatus.

15. A photographic processing apparatus according to claim 11, wherein a plurality of pairs of said processing tank and said replenisher supplying mechanism are provided, and the replenishers remaining respectively in said replenisher containers are forcibly supplied to said processing tanks, respectively, upon completion of the processing of the predetermined quantity of photosensitive material.

16. A photographic processing apparatus according to claim 11, wherein said replenisher supplying mechanism includes a bellows pump and a motor for driving said bellows pump, and said emptiness detecting mechanism detects the emptiness of said replenisher container on the basis of a change in a pulse width of an output pulse signal from a detector for detecting the operation of said bellows pump.

* * * * *